US009772583B2

(12) United States Patent
Kikuchi

(10) Patent No.: US 9,772,583 B2
(45) Date of Patent: Sep. 26, 2017

(54) CLEANING DEVICE AND IMAGE FORMING APPARATUS

(71) Applicant: KYOCERA Document Solutions Inc., Osaka (JP)

(72) Inventor: Einosuke Kikuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/207,058

(22) Filed: Jul. 11, 2016

(65) Prior Publication Data

US 2017/0031301 A1 Feb. 2, 2017

(30) Foreign Application Priority Data

Jul. 29, 2015 (JP) ..... 2015-0149489

(51) Int. Cl.
*G03G 15/16* (2006.01)
*G03G 21/00* (2006.01)

(52) U.S. Cl.
CPC ..... *G03G 15/161* (2013.01); *G03G 21/007* (2013.01); *G03G 21/0058* (2013.01); *G03G 2215/0132* (2013.01)

(58) Field of Classification Search
CPC ..... G03G 15/161; G03G 21/0058; G03G 21/0035; G03G 21/0011; G03G 21/007; G03G 2221/0089
See application file for complete search history.

(56) References Cited

U.S. PATENT DOCUMENTS 5,761,598 A * 6/1998 Kazakos ..... G03G 21/0035 399/349
2003/0108360 A1* 6/2003 Ogasawara ..... G03G 21/0011 399/159
2008/0101834 A1* 5/2008 Iwasaki ..... G03G 21/0035 399/357
2010/0239302 A1* 9/2010 Naruse ..... G03G 21/0035 399/71
2012/0121307 A1* 5/2012 Shiiya ..... G03G 15/10 399/348

FOREIGN PATENT DOCUMENTS

JP 2008-096630 A 4/2008

* cited by examiner

*Primary Examiner* — Carla Therrien
(74) *Attorney, Agent, or Firm* — Studebaker & Brackett PC

(57) ABSTRACT

A cleaning device includes a cleaning member, a collecting roller and a cleaning blade. The cleaning member is disposed to be rotatable while being in contact with a surface of an image carrier configured to carry a toner image to the surface. The collecting roller is disposed to be rotatable while being in contact with the cleaning member at a downstream side from the image carrier in a rotation direction of the cleaning member. The cleaning blade is disposed while being in contact with the collecting roller in a counter direction with respect to rotation of the collecting roller at a downstream side from the cleaning member in a rotation direction of the collecting roller. The collecting roller is formed so as to have larger surface roughness at an end than that at a central part in an axial direction.

8 Claims, 5 Drawing Sheets

FIG. 4

| SURFACE ROUGHNESS Rz [μm] | BLADE TURNING-UP | SCRAPING PROPERTY (SPHERICITY: LOW) |
|---|---|---|
| 0.5 | × | ○ |
| 1 | × | ○ |
| 1.5 | ○ | ○ |
| 2 | ○ | ○ |
| 2.5 | ○ | × |
| 3 | ○ | × |

FIG. 5

| SURFACE ROUGHNESS Rz [μm] | BLADE TURNING-UP | SCRAPING PROPERTY (SPHERICITY: HIGH) |
|---|---|---|
| 0.5 | × | ○ |
| 1 | × | ○ |
| 1.5 | ○ | × |
| 2 | ○ | × |
| 2.5 | ○ | × |
| 3 | ○ | × |

CLEANING DEVICE AND IMAGE FORMING APPARATUS

INCORPORATION BY REFERENCE

This application is based on and claims the benefit of priority from Japanese Patent application No. 2015-149489 filed on Jul. 29, 2015, the entire contents of which are incorporated herein by reference.

BACKGROUND

The present disclosure relates to a cleaning device which collects a toner and other residue having remained on a surface of an image carrier, such as an intermediate transferring belt and an image forming apparatus including this cleaning device.

Conventionally, an image forming apparatus, such as a copying machine, a printer, a facsimile machine or a multifunction peripheral, is configured to transfer to a sheet a toner image carried onto an image carrier, such as an intermediate transferring belt or a photosensitive drum. Such an image forming apparatus may include a cleaning device which catches a residue, such as a residual toner or sheet powder, having adhered to a surface of the image carrier after the toner image has been transferred.

The cleaning device includes, for example, a rotating brush (a fur brush), a collecting roller, a cleaning blade, and a collecting screw. In addition, the rotating brush coming into contact with the surface of the image carrier catches the residue having adhered to the surface of the image carrier, whereas the collecting roller coming into contact with the rotating brush collects the residue having been caught by the rotating brush. The cleaning blade abuts against the collecting roller in a counter direction with respect to rotation of the collecting roller, and then, drops the residue collected by the collecting roller to the collecting screw.

For example, the cleaning device may be configured so that an elastic blade (a cleaning blade) scrapes the residual toner from the image carrier, and then, drops the scraped residual toner to a residual toner collecting member (a collecting screw). In this cleaning device, at an upstream side from an abutment part of the cleaning blade and the image carrier in a rotation direction of the image carrier, a sealing member is disposed while being in abutment against the surface of the image carrier, thereby preventing the residual toner from accumulating or leaking to a side of the image carrier side.

In a case where the sealing member is applied to the cleaning device including the collecting roller mentioned above, the sealing member is provided so as to abut against the collecting roller against which the cleaning blade has abutted. However, in this case, in order to make the sealing member excellently act, it is necessary to construct the cleaning device in consideration of parameters, such as a material and surface roughness of the collecting roller, as well as an electrostatic friction coefficient of the sealing member.

For example, in a case where the surface roughness of the collecting roller is extremely low, clogging of the residue, such as the toner or the sheet powder, between the collecting roller and the sealing member easily occurs, and moreover, it becomes difficult for the collecting roller to collect the adhered matter having caught by the rotating brush. Alternatively, in a case where the surface roughness of the collecting roller is extremely high, toner scraping property by the cleaning blade may be deteriorated.

Incidentally, the scraping property of the cleaning blade is deteriorated more, as toner sphericity is closer to a spherical shape. The scraping property of the cleaning blade can make excellent by lowering the surface roughness of the collecting roller irrespective of the toner sphericity. However, in such a case, as mentioned above, the clogging of the residue may occur between the collecting roller and the sealing member.

Also, when the collecting roller is made of a material of higher adhesive force, whereby even in a case where the surface roughness of the collecting roller is lowered, the clogging of the residue between the collecting roller and the sealing member may be released. However, if the surface roughness of the collecting roller has been extremely lowered in accordance with the toner sphericity, close contact property between the collecting roller and the cleaning blade increases and it is feared to cause blade turning-up of the cleaning blade and other failures.

SUMMARY

In accordance with the present disclosure, a cleaning device includes a cleaning member, a collecting roller and a cleaning blade. The cleaning member is disposed to be rotatable while being in contact with a surface of an image carrier configured to carry a toner image to the surface. The collecting roller is disposed to be rotatable while being in contact with the cleaning member at a downstream side from the image carrier in a rotation direction of the cleaning member. The cleaning blade is disposed while being in contact with the collecting roller in a counter direction with respect to rotation of the collecting roller at a downstream side from the cleaning member in a rotation direction of the collecting roller. The collecting roller is formed so as to have larger surface roughness at an end than that at a central part in an axial direction.

In accordance with the present disclosure, an image forming apparatus includes the above-mentioned cleaning device and the above-mentioned image carrier.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 4 is a table showing a relationship among surface roughness of a collecting roller, blade turning-up of a cleaning blade and scraping property of the cleaning blade in a case where toner sphericity is low.

FIG. 5 is a chart showing a relationship among the surface roughness of the collecting roller, the blade turning-up of the cleaning blade and the scraping property of the cleaning blade in a case where the toner sphericity is high.

DETAILED DESCRIPTION

Figure 1:
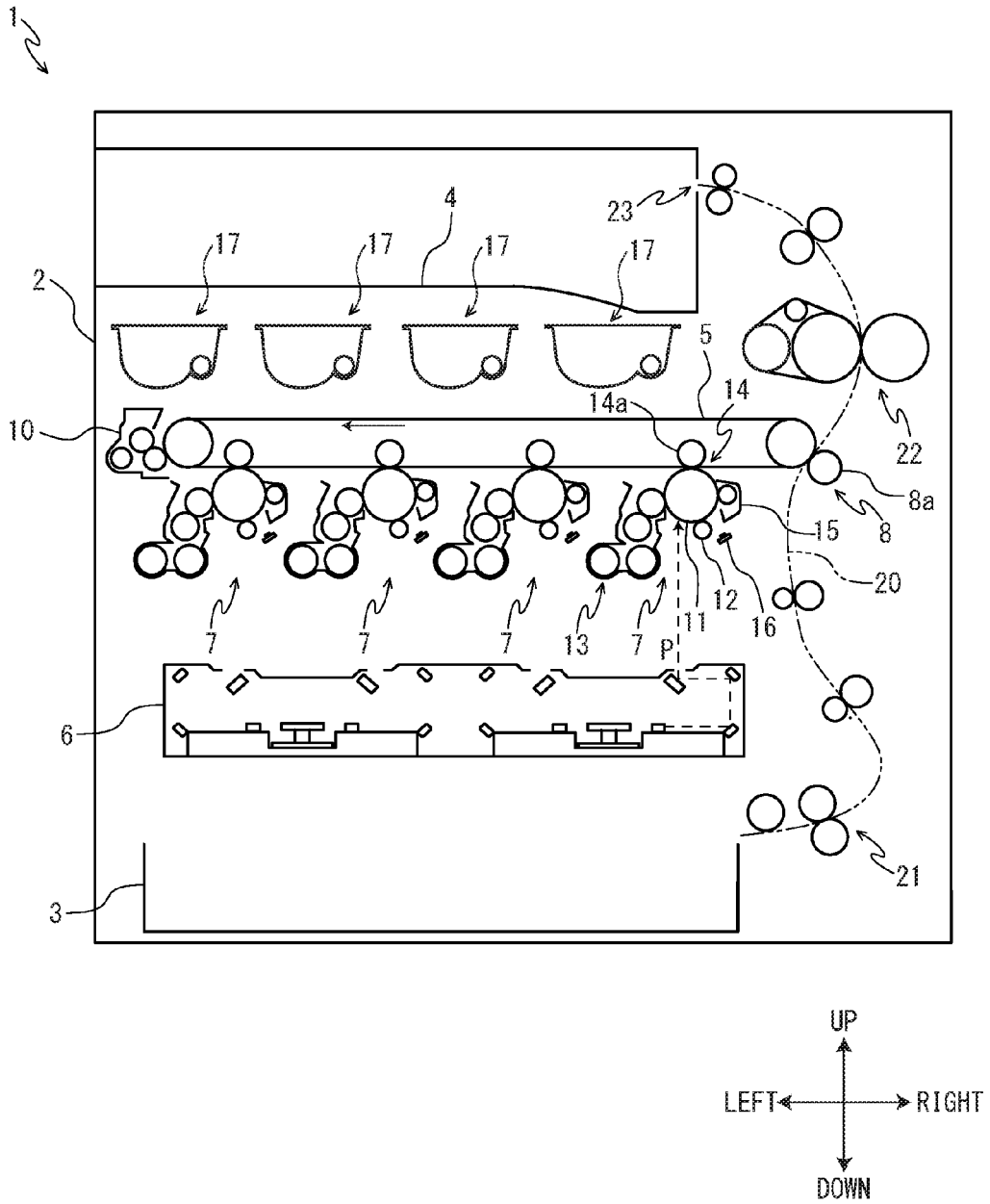
FIG. 1 is a schematic view schematically showing a structure of a color printer according to a first embodiment of the present disclosure.

Firstly, the entire structure of a color printer 1 (an image forming apparatus) according to an embodiment of the present disclosure will be described with reference to FIG. 1. Hereinafter, it will be described so that a front side of the color printer 1 is positioned at the near side on FIG. 1, for convenience of explanation.

The color printer 1 includes a box-formed printer main body 2. In a lower part of the printer main body 2, a sheet feeding cartridge 3 storing a sheet (a recording medium) is arranged. In an upper part of the printer main body 2, an ejected sheet tray 4 is arranged.

In a middle part inside the printer main body 2, an intermediate transferring belt 5 (an image carrier) is disposed around a plurality of rollers. Below the intermediate transferring belt 5, an exposure device 6 composed of a laser scanning unit (LSU) is arranged. At a lower side of the intermediate transferring belt 5, four image forming parts 7 are installed for respective colors (e.g. four colors of magenta, cyan, yellow and black) of toners. At a right end of the intermediate transferring belt 5, a second transferring part 8 is arranged and, at a left end of the intermediate transferring belt 5, a cleaning device 10 is arranged. The second transferring part 8 is composed of a part at the right end side of the intermediate transferring belt 5 and a second transferring roller 8*a*.

In each image forming part 7, a photosensitive drum 11 is rotatably arranged. Around the photosensitive drum 11, a charger 12, a development device 13, a first transferring part 14, a cleaning part 15 and a static eliminator 16 are located in order of first transferring processes. Above the development device 13, toner containers 17 corresponding to the respective image forming parts 7 are arranged for the respective toner colors (e.g. four colors of magenta, cyan, yellow and black). The first transferring part 14 is composed of a part at a side of each photosensitive drum 11 of the intermediate transferring belt 5 and a first transferring roller 14*a*.

At one side (at a right side on the figure) inside the printer main body 2, a conveying path 20 for the sheet is arranged. At an upstream end of the conveying path 20, a sheet feeding part 21 is positioned. At an intermediate stream part of the conveying path 20, the above-mentioned second transferring part 8 is positioned. At a downstream part of the conveying path 20, a fixing device 22 is positioned. At a downstream end of the conveying path 20, a sheet ejection port 23 is positioned.

Next, the operation of forming an image by the color printer 1 having such a configuration will be described. When the power is supplied to the color printer 1, various parameters are initialized and initial determination, such as temperature determination of the fixing device 22, is carried out. Subsequently, in the color printer 1, when image data is inputted and a printing start is directed from a computer or the like connected with the color printer 1, image forming operation is carried out as follows.

Firstly, the surface of the photosensitive drum 11 is electrically charged by the charger 12. Then, an electrostatic latent image is formed on the surface of the photosensitive drum 11 by a laser light (refer to an arrow P) from the exposure device 6. The electrostatic latent image is developed to a toner image having a correspondent color in the development device 13 by the toner supplied from the toner container 17. The toner image is first-transferred onto the surface of the intermediate transferring belt 5 in the first transferring part 14. For example, in the first transferring part 14, by applying voltage with reversed polarity of the toner to the first transferring roller 14*a*, the toner image formed on the photosensitive drum 11 is first-transferred onto the intermediate transferring belt 5. The above-mentioned operation is repeated in order by the respective image forming parts 7, thereby forming the toner image having full color onto the intermediate transferring belt 5. Incidentally, toner and electric charge remained on the photosensitive drum 11 are removed by the cleaning part 15 and the static eliminator 16.

On the other hand, the sheet taken out from the sheet feeding cartridge 3 or a manual bypass tray (not shown) by the sheet feeding part 21 is conveyed to the second transferring part 8 in a suitable timing for the above-mentioned image forming operation. Then, in the second transferring part 8, the toner image having full color on the intermediate transferring belt 5 is second-transferred onto the sheet. The sheet with the second-transferred toner image is conveyed to a downstream side on the conveying path 20 to enter the fixing device 22, and then, the toner image is fixed on the sheet in the fixing device 22. The sheet with the fixed toner image is ejected from the sheet ejection port 23 onto the ejected sheet tray 4.

Figure 2:
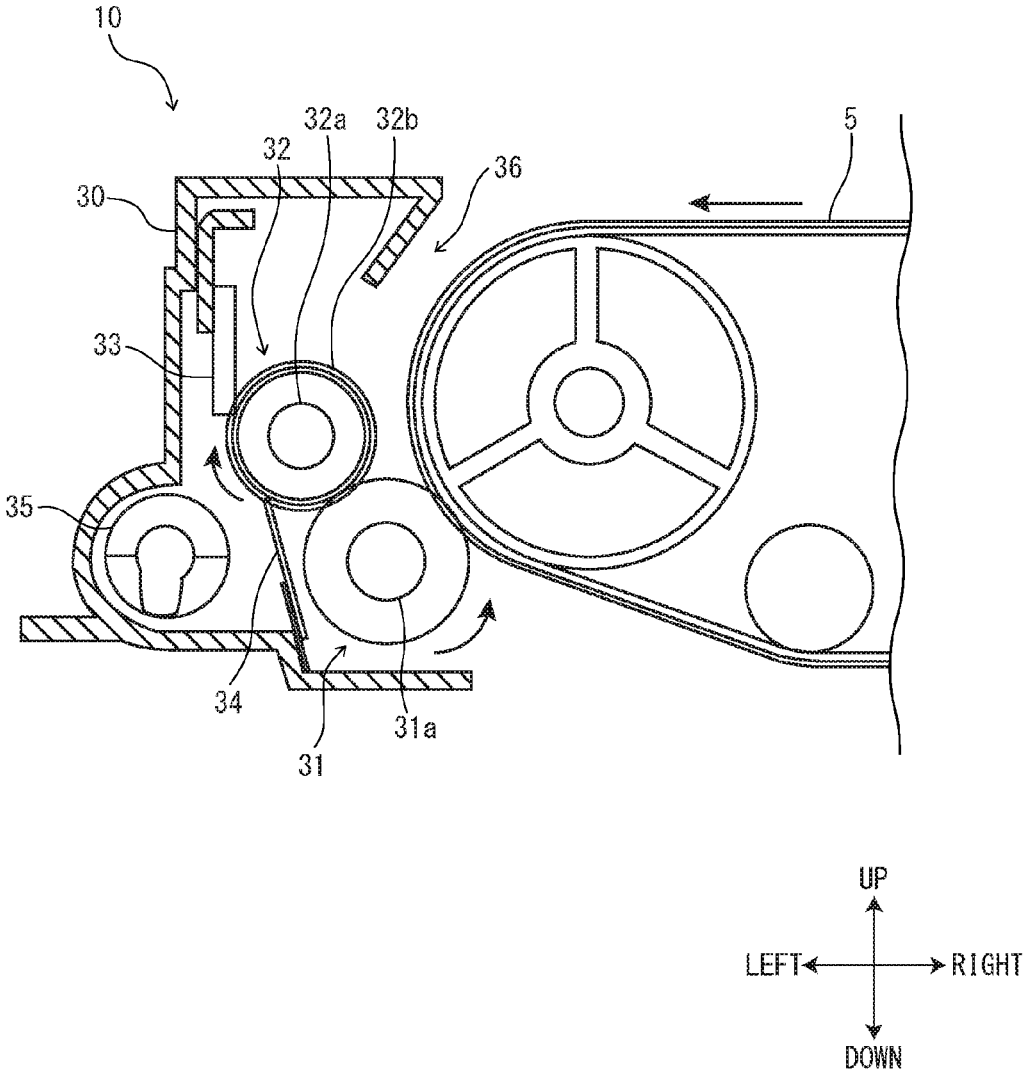
FIG. 2 is a sectional view showing a cleaning device and its periphery of the color printer according to the first embodiment of the present disclosure.

Next, with reference to FIG. 2 and FIG. 3, the cleaning device 10 will be described. As shown in FIG. 2, the cleaning device 10 includes a casing 30, a fur brush 31 (a cleaning member), a collecting roller 32, a cleaning blade 33, a sealing member 34 and a collecting screw 35.

The casing 30 is formed in a substantially box-like shape having an aperture 36 at a right end thereof. The casing 30 is disposed at a position at which the aperture 36 is made close to a left end of an intermediate transferring belt 5, for example, at a position at which the left end of the intermediate transferring belt 5 is slightly inserted to the aperture 36.

The fur brush 31 is a cleaning member including a rotating shaft 31*a* elongated in forward and backward directions and many brush hairs (not shown) extending at a predetermined length in a radial direction from the rotating shaft 31*a*. An axial direction of the fur brush 31 is parallel to an axial direction of the intermediate transferring belt 5. As shown in FIG. 3, a length L2 in the axial direction of the fur brush 31 is longer than a length L1 in the axial direction of the intermediate transferring belt 5, and both ends in the axial direction of the fur brush 31 (both ends in the forward and backward directions) are positioned at the outside from the intermediate transferring belt 5 in the forward and backward directions. In addition, the fur brush 31 is disposed to be rotatable while being in contact with a surface at a left end side of the intermediate transferring belt 5 and rotates in a counterclockwise direction in a front view at the time of operation of the cleaning device 10. For example, the fur brush 31 is provided, for example, at a right lower part in the casing 30 and in the vicinity of the aperture 36 and is disposed so that tip ends of the brush hairs come into contact with the intermediate transferring belt 5.

The collecting roller 32 is a columnar collecting member including a rotating shaft 32*a* elongated in the forward and backward directions and a roller main body 32*b* provided around the rotating shaft 32*a*. The collecting roller 32 may be constructed to be integrated with the rotating shaft 32*a* and the roller main body 32*b*. An axial direction of the collecting roller 32 is also parallel to the axial direction of the intermediate transferring belt 5. A length L3 in the axial direction of the collecting roller 32 is longer than any length of the length L1 in the axial direction of the intermediate transferring belt 5, the length L2 in the axial direction of the fur brush 31, a length L4 in the forward and backward directions of the cleaning blade 33, and a length in the forward and backward directions of the sealing member 34 and both ends in the axial direction of the collecting roller 32 (both ends in the forward and backward directions) are positioned at the outside from the sealing member 34 in the forward and backward directions. In addition, the collecting roller 32 is disposed to be rotatable while being in contact with the fur brush 31 at the downstream side from the intermediate transferring belt 5 in a rotation direction of the fur brush 31 and rotates in the clockwise direction in a front view at the time of operation of the cleaning device 10. For example, the collecting roller 32 is provided at a substantially central part in the casing 30 and an outer circumferential face thereof is disposed so as to come into contact with tip ends of the brush hairs (not shown) of the fur brush 31.

The collecting roller 32 is made of a metal material, such as aluminum, so as to have a roller top layer of which electrical resistance is comparatively high and is formed, for example, to have a surface layer of which electrical resistance is $10^6$ to $10^{14}$ Ωcm. For example, the collecting roller 32 is subjected to alumite treatment to form an anode oxidization film in an aluminum element pipe and is made of a material of which surface resistance and hardness are comparatively high. Since the alumite treatment forms an alumite layer while maintaining a surface property of the aluminum element pipe, the collecting roller 32 is configured to have an alumite layer of which the surface property is high (surface roughness is small) and to have a high cleaning property.

The cleaning blade 33 is a plate-formed member elongated in the forward and backward directions. The length L4 in the forward and backward directions of the cleaning blade 33 is longer than the length L2 in the axial direction of the fur brush 31 and both ends in the forward and backward directions of the cleaning blade 33 are positioned at the outside from the fur brush 31 in the forward and backward directions. In addition, the cleaning blade 33 is disposed while being in contact with the collecting roller 32 in a counter direction with respect to rotation of the collecting roller 32 at the downstream side from the fur brush 31 and the sealing member 34 in a rotation direction of the collecting roller 32. For example, the cleaning blade 33 is attached to an upper part in the casing 30 at the left side of the collecting roller 32, and is disposed while extending downwardly from the upper part in the casing 30 so that a tip end thereof abuts against a surface of the collecting roller 32 from an upper side.

The sealing member 34 is a sheet-formed member elongated in the forward and backward directions. A length in the forward and backward directions of the sealing member 34 is longer than the length L4 in the forward and backward directions of the cleaning blade 33, and both ends in the forward and backward directions of the sealing member 34 are positioned at the outside from the cleaning blade 33 in the forward and backward directions. In addition, the sealing member 34 is disposed while being in contact with the collecting roller 32 at the downstream side from the fur brush 31 in the rotation direction of the collecting roller 32. For example, the sealing member 34 is attached to a lower part in the casing 30 at the left side of the fur brush 31, and is disposed while extending upwardly from the lower part of the casing 30 so that a tip end thereof abuts against the surface of the collecting roller 32 from a lower side.

The collecting screw 35 is a screw member elongated in the forward and backward directions. For example, the collecting screw 35 is rotatably attached to a left lower part in the casing 30. The collecting screw 35 is disposed at the left side of the collecting roller 32, the cleaning blade 33 and the sealing member 34, and a leakage and a backflow of the toner from the collecting screw 35 to a side of the collecting roller 32 are prevented by the sealing member 34.

Next, a relationship among surface roughness of the collecting roller 32 and blade turning-up and scraping property of the cleaning blade 33 will be described with reference to FIG. 4 to FIG. 6. In FIG. 4 and FIG. 5, with respect to blade turning-up, a case in which the turning-up of the cleaning blade 33 does not occur is indicated by O, and a case in which the turning-up thereof occurs is indicated by X. Also, in FIG. 4 and FIG. 5, with respect to scraping property, a case in which the toner scraping property by the cleaning blade 3 is excellent is indicated by O, and a case in which the scraping property thereof is deteriorated is indicated by X.

FIG. 4 shows the above-mentioned relationship in a case where toner sphericity is comparatively low, for example, in a case where the sphericity is 0.955. In the case where the toner sphericity is low, when the surface roughness of the collecting roller 32 is 1.5 to 2 Rz, it is possible to maintain the toner scraping property by the cleaning blade 33 in an excellent state without causing the turning-up of the cleaning blade 33. That is, in the case where the toner sphericity is low, there exists the surface roughness of the collecting roller 32 which is capable of ensuring that the scraping property and the blade turning-up of the cleaning blade 33 are compatible with each other.

FIG. 5 shows the above-mentioned relationship in a case where the toner sphericity is comparatively high, for example, in a case where the sphericity is 0.985. In the case where the toner sphericity is high, in order to maintain the toner scraping property by the cleaning blade 33 in an excellent state, it is necessary to lower the surface roughness of the collecting roller 32 in comparison with the case in which the toner sphericity is low. However, if the surface roughness of the collecting roller 32 is lowered, the turning-up of the cleaning blade 33 easily occurs. That is, in the case where the toner sphericity is high, it is difficult to set the surface roughness of the collecting roller 32 to be constant so as to ensure that the scraping property and the blade turning-up of the cleaning blade 33 are compatible with each other.

Figure 3:
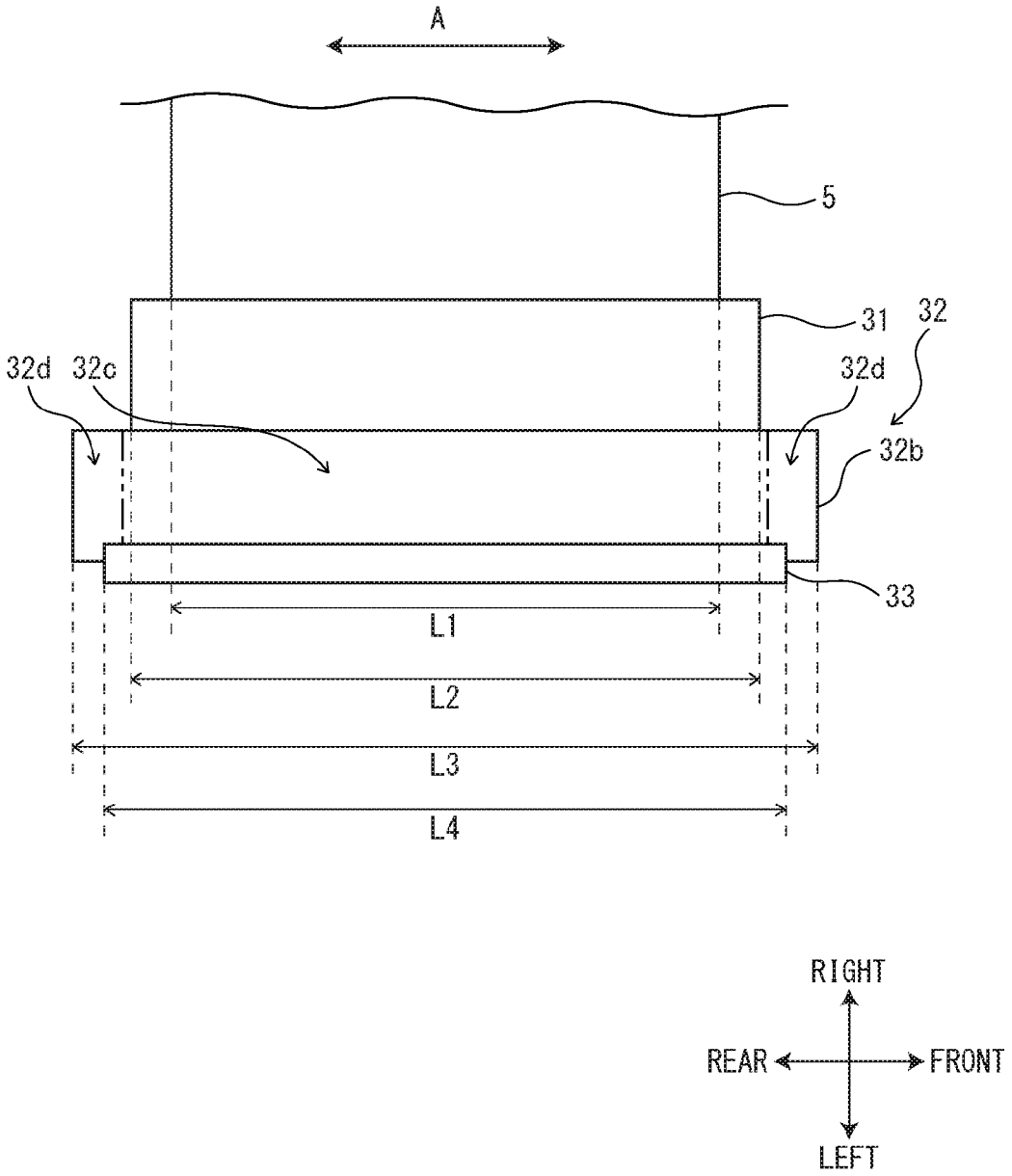
FIG. 3 is a plan view showing the cleaning device and its periphery of the color printer according to the first embodiment of the present disclosure.

Incidentally, since the toner that adheres to the surface of the intermediate transferring belt 5 is small in amount at both ends in comparison with a central part in the forward and backward directions, the toner scraped from the intermediate transferring belt 5 by the fur brush 31 and collected by the collecting roller 32 becomes small in amount at both ends 32*d* in comparison with a central part 32*c* in an axial direction (refer to FIG. 3). Therefore, it is necessary to make the scraping property of the cleaning blade 33 at the central part higher than those at both ends in the axial direction. Also, since both ends in the axial direction of the cleaning blade 33 come into contact with both ends 32*d* of the collecting roller 32 of which amount of toner is small, close contact property therebetween increases and the blade turning-up easily occurs in comparison with the central part in the axial direction. Therefore, it is necessary to prevent the blade turning-up of the cleaning blade 33 at both ends more significantly than that at the central part in the axial direction.

Accordingly, the collecting roller 32 is configured to have different surface properties (the surface roughness) between the central part 32*c* and each end 32*d* in the axial direction (the longitudinal direction) so that the surface property at each end 32*d* is lower than that at the central part 32*c* (the surface roughness at each end 32*d* is larger). For example, in a case where the collecting roller 32 made of an aluminum element pipe is fabricated, after polishing treatment has been applied to the aluminum element pipe in different polishing conditions between the central part 32*c* and each end 32*d* in the axial direction, the aluminum element pipe is subjected to alumite treatment, thereby making it possible to obtain the collecting roller 32 having different surface properties between the central part 32*a* and each end 32*d* in the axial direction.

Figure 6:
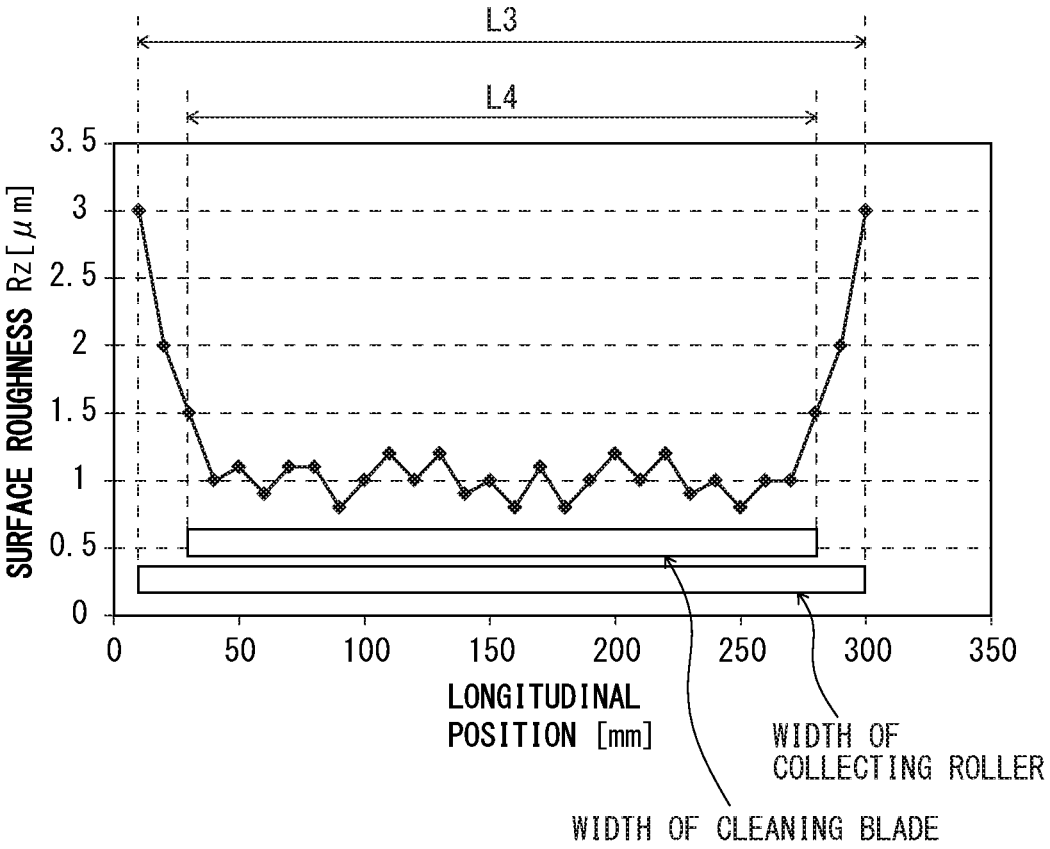
FIG. 6 is a graph plotting the surface roughness of the collecting roller in the cleaning device of the color printer according to the first embodiment of the present disclosure.

FIG. 6 shows a relationship between a position in the longitudinal direction (the axial direction) and the surface roughness of the collecting roller 32. Incidentally, in FIG. 6, the collecting roller 32 and the cleaning blade 33 are schematically illustrated. As shown in FIG. 6, the surface roughness of the collecting roller 32 is set to be low, for example, to be approximately 1, in a range corresponding to the central part of the cleaning blade 33 in the axial direction (the central part 32*c* in the axial direction), thereby making the toner scraping property by the cleaning blade 33 excellent. In addition, the surface roughness of the collecting roller is set to be high at each end 32*d* in the axial direction, for example, is set to be gradually higher from each end of the cleaning blade 33 (for example, from a position between each edge of the fur brush 31 and each edge of the cleaning blade 33 in the axial direction) to the outside in the axial direction, thereby preventing the blade turning-up of the cleaning blade 33.

According to the embodiment, as described above, the cleaning device 10 of the color printer 1 includes the fur brush 31 (the cleaning member) disposed to be rotatable while being in contact with the surface of the intermediate transferring belt 5 (the image carrier) carrying the toner image to the surface, the collecting roller 32 disposed to be rotatable while being in contact with the fur brush 31 at the downstream side from the intermediate transferring belt 5 in the rotation direction of the fur brush 31 and the cleaning blade 33 disposed while being in contact with the collecting roller 32 in the counter direction at the downstream side from the fur brush 31 in the rotation direction of the collecting roller 32. The collecting roller 32 is formed so as to have the larger surface roughness at an end 32*d* than that at the center 32*c* in the axial direction.

Thus, in the collecting roller 32, by lowering the surface roughness in a region in which the toner is more frequently scraped (the central part 32*c* in the axial direction) and heightening the surface roughness to another region (each end 32*d* in the axial direction), it is possible to excellently collect the toner by the collecting roller 32 and to weaken the close contact property between the cleaning blade 33 and the collecting roller 32 all over in the axial direction. In this manner, irrespective of the use state, such as the sphericity of the toner collected by the cleaning device 10, it is possible to make the scraping property of the cleaning blade 33 coming into contact with the collecting roller 32 excellent at the central part 32*c* than at each end 32*d* in the axial direction and to prevent the blade turning-up of the cleaning blade 33 at each end 32*d* in the axial direction in particular. Therefore, it is possible to ensure a stable cleaning property of the cleaning device irrespective of the use state, such as the toner sphericity.

In addition, according to the embodiment, the collecting roller 32 has a surface layer of which electrical resistance is $10^6$ to $10^{14}$ Ωcm. In this manner, irrespective of the surface roughness according to the position in the axial direction of the collecting roller 32, it is possible to form the collecting roller 32 capable of increasing an adsorptive power of sheet powder and the toner by high electrical resistance.

Further, according to the embodiment, the collecting roller 32 is made of the metal material polished in different polishing conditions between the central part 32*c* and each end 32*d* in the axial direction. In this manner, it is possible to form the collecting roller 32 having high surface resistance and high hardness by using the metal material of which surface is easily polished.

Furthermore, according to the embodiment, the collecting roller 32 is made of aluminum to which alumite treatment is applied. In this manner, it is possible to obtain the collecting roller 32 having the higher surface property (the low surface roughness) at the central part 32*c* in the axial direction and the higher hardness all over in the axial direction.

Although the embodiment was described as to the construction in which the fur brush 31 is applied as the cleaning member, the cleaning member is not limited to the fur brush 31. For example, in another embodiment, the cleaning member may be a cleaning roller or another cleaning member.

In addition, although the embodiment was described as to the construction in which the intermediate transferring belt 5 is applied as an image carrier, the image carrier is not limited to the intermediate transferring belt 5. For example, in another embodiment, the image carrier may be a photosensitive drum or another image carrier.

The embodiment was described in a case of applying the configuration of the present disclosure to the color printer 1. On the other hand, in another embodiment, the configuration of the disclosure may be applied to another image forming apparatus, such as a monochrome printer, a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A cleaning device comprising:

a cleaning member disposed to be rotatable while being in contact with a surface of an image carrier configured to carry a toner image on the surface;

a collecting roller disposed to be rotatable while being in contact with the cleaning member at a downstream side from the image carrier in a rotation direction of the cleaning member; and a cleaning blade disposed while being in contact with the collecting roller in a counter direction with respect to rotation of the collecting roller at a downstream side from the cleaning member in a rotation direction of the collecting roller, wherein the collecting roller is formed so as to have larger surface roughness at an end than that at a central part in an axial direction, the collecting roller has a longer length in the axial direction than any of lengths of the image carrier, the cleaning member and the cleaning blade, wherein the collecting roller has surface roughness which is gradually higher from a position at each end of the cleaning blade to the outside in the axial direction.

2. The cleaning device according to claim 1, wherein the collecting roller has a surface layer of which electrical resistance is $10^6$ to $10^{14}$ Ωcm.

3. An image forming apparatus comprising the cleaning device according to claim 2 and the image carrier.

4. The cleaning device according to claim 1, wherein the collecting roller is made of a metal material polished in different polishing conditions between the central part and each end of the collecting roller in the axial direction.

5. The cleaning device according to claim 4, wherein the collecting roller is made of aluminum to which alumite treatment is applied.

6. An image forming apparatus comprising the cleaning device according to claim 5 and the image carrier.

7. An image forming apparatus comprising the cleaning device according to claim 4 and the image carrier.

8. An image forming apparatus comprising the cleaning device according to claim 1 and the image carrier.

* * * * *